US012504021B2

(12) United States Patent
Tanaka

(10) Patent No.: US 12,504,021 B2
(45) Date of Patent: Dec. 23, 2025

(54) COMPRESSOR WITH BYPASS FOR INTERSTAGE PASSAGE

(71) Applicant: IHI Corporation, Tokyo (JP)

(72) Inventor: Ryuuta Tanaka, Tokyo (JP)

( * ) Notice: Subject to any disclaimer, the term of this patent is extended or adjusted under 35 U.S.C. 154(b) by 0 days.

(21) Appl. No.: 19/277,394

(22) Filed: Jul. 23, 2025

(65) Prior Publication Data

US 2025/0347290 A1 Nov. 13, 2025

Related U.S. Application Data

(63) Continuation of application No. PCT/JP2024/004898, filed on Feb. 13, 2024.

(30) Foreign Application Priority Data

Feb. 16, 2023 (JP) ..... 2023-022703

(51) Int. Cl.
*F04D 29/28* (2006.01)
*F04D 17/12* (2006.01)

(52) U.S. Cl.
CPC ..... *F04D 29/286* (2013.01); *F04D 17/12* (2013.01)

(58) Field of Classification Search
CPC ..... F04D 29/286; F04D 17/12
See application file for complete search history.

(56) References Cited

U.S. PATENT DOCUMENTS 2,305,226 A * 12/1942 Stalker ..... F04D 29/684 415/115
7,553,122 B2 * 6/2009 Kirtley ..... F04D 27/0207 415/1
9,382,911 B2 * 7/2016 Sun ..... F04D 27/0238
2015/0128640 A1 5/2015 Sun et al.

FOREIGN PATENT DOCUMENTS

| | | |
|---|---|---|
| EP | 4339464 | 3/2024 |
| JP | 2010-174806 | 8/2010 |
| JP | 2016-539311 | 12/2016 |
| WO | 2015/073835 | 5/2015 |
| WO | 2022/240096 | 11/2022 |

OTHER PUBLICATIONS

International Search Report dated May 7, 2024 for PCT/JP2024/004898.
International Preliminary Report on Patentability with Written Opinion dated Aug. 28, 2025 for PCT/JP2024/004898.

* cited by examiner

*Primary Examiner* — Eldon T Brockman
(74) *Attorney, Agent, or Firm* — SHIPWAY IP

(57) ABSTRACT

A compressor includes a first impeller that compresses a gas, a second impeller that further compresses the gas and that directs the gas to a downstream region that is located downstream of the second impeller, an interstage passage that directs the gas from the first impeller to the second impeller, and a bypass passage that recirculates the gas from the downstream region of the second impeller to the interstage passage. The bypass passage has a downstream end that opens to the interstage passage to direct the recirculated gas into the interstage passage.

20 Claims, 4 Drawing Sheets

COMPRESSOR WITH BYPASS FOR INTERSTAGE PASSAGE

CROSS-REFERENCE TO RELATED APPLICATIONS

This application is a continuation application of PCT Application No. PCT/JP2024/004898, filed on Feb. 13, 2024, which claims the benefit of priority from Japanese Patent Application No. 2023-022703, filed on Feb. 16, 2023, the entire contents of which are incorporated herein by reference.

BACKGROUND

Japanese Unexamined Patent Publication No. 2010-174806 describes a centrifugal compressor having an impeller configured in one stage and including a bypass passage that returns a portion of high-pressure air in a scroll passage to an inlet of an impeller in consideration of surging. In a multistage compressor including two or more stages, gas compressed by a first impeller upstream is further compressed by a second impeller downstream. In such a multistage compressor, a swirling flow generated in the gas when the gas is compressed by the first impeller may affect a compression performance of the second impeller.

SUMMARY

An example compressor in which gas compressed by a first impeller is further compressed by a second impeller includes: an interstage passage that introduces the gas from the first impeller to the second impeller; and a bypass passage that recirculates the gas from downstream of the second impeller to the interstage passage. A downstream end of the bypass passage opens to the interstage passage so as to face a direction in which the gas in the interstage passage swirls in a passage cross-section of the interstage passage.

DETAILED DESCRIPTION

Figure 1:
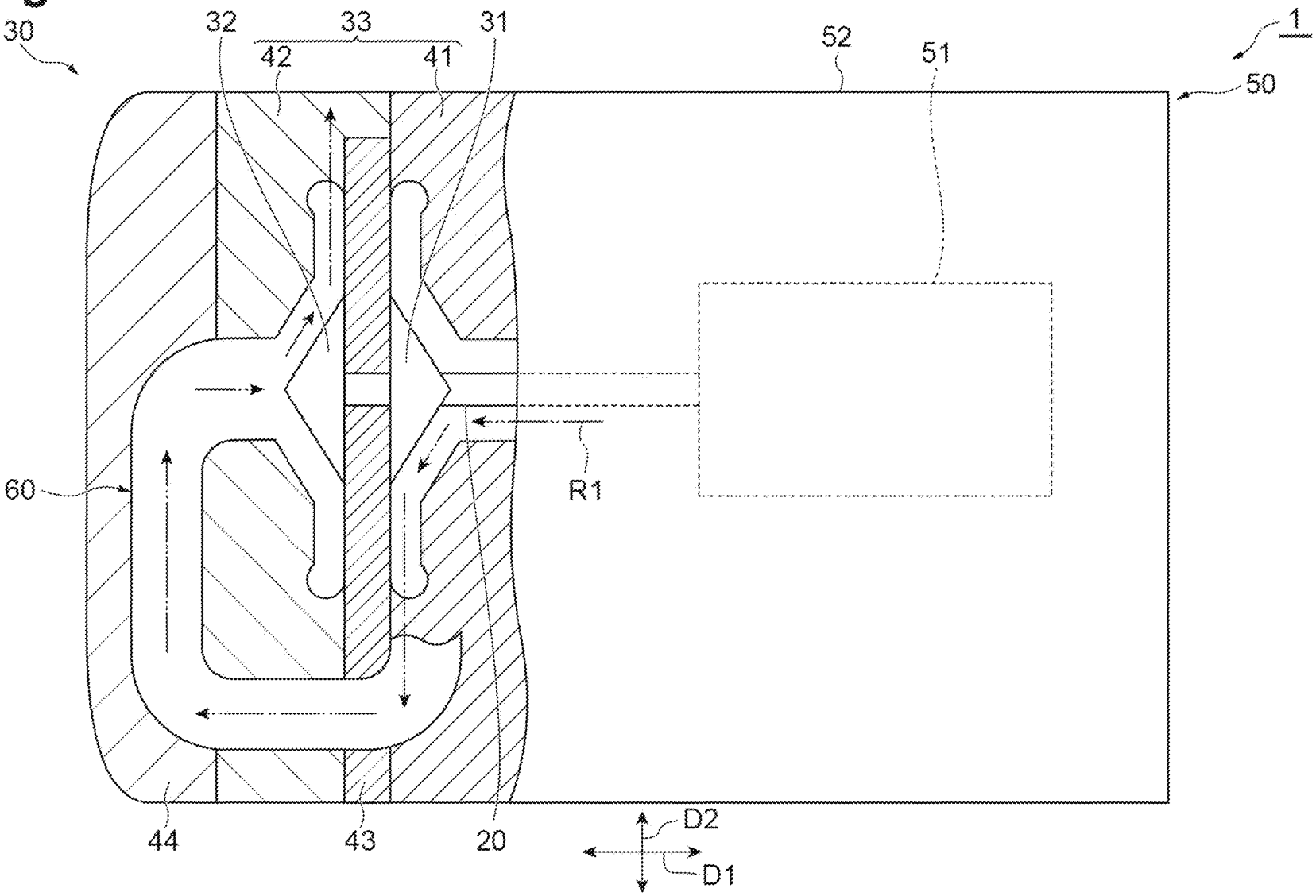
FIG. 1 is a schematic cross-sectional view of an example compressor.

Hereinafter, with reference to the drawings, the same elements or similar elements having the same function are denoted by the same reference numerals, and redundant description will be omitted.

An example compressor in which gas compressed by a first impeller is further compressed by a second impeller includes an interstage passage that introduces the gas from the first impeller to the second impeller; and a bypass passage that recirculates the gas from downstream of the second impeller to the interstage passage. A downstream end of the bypass passage opens to the interstage passage so as to face a direction in which the gas in the interstage passage swirls in a passage cross-section of the interstage passage.

In the example compressor, the gas compressed by the second impeller is recirculated to the interstage passage from downstream of the second impeller via the bypass passage, and flows out from the downstream end of the bypass passage into the interstage passage. The downstream end of the bypass passage faces the direction in which the gas in the interstage passage swirls in the passage cross-section of the interstage passage. Accordingly, the swirling flow generated in the gas when the gas is compressed by the first impeller is weakened by the gas flowing out from the downstream end of the bypass passage into the interstage passage. Therefore, in the example compressor, the influence of the swirling flow, which is generated in the gas when the gas is compressed by the first impeller, on the second impeller can be suppressed.

In some examples, the interstage passage may include a bent portion at an inlet portion of the second impeller, and the downstream end of the bypass passage may open downstream of the bent portion. According to this example, since the swirling flow is weakened at the inlet portion of the second impeller, the influence of the swirling flow on the second impeller can be effectively suppressed.

In some examples, an opening direction of the downstream end may be along a tangent direction of an imaginary concentric circle concentric with a shaft of the second impeller. According to this example, since the gas to be recirculated flows out along a tangent to the concentric circle of the shaft of the second impeller, the influence of the swirling flow having a flow speed component along a circumferential direction of the concentric circle can be suppressed more effectively.

In some examples, an opening position of the downstream end may be on an imaginary line extending in a radial direction of an imaginary concentric circle concentric with a shaft of the second impeller, and the imaginary line and an opening direction of the downstream end may be perpendicular to each other. According to this example, since the gas to be recirculated flows out to face the swirling flow on the tangent to the concentric circle of the shaft of the second impeller, the influence of the swirling flow having a flow speed component of the concentric circle can be suppressed more effectively.

Hereinafter, an example compressor will be described in detail with reference to the drawings.

A compressor 1 illustrated in FIG. 1 is, for example, a series two-stage compressor. The compressor 1 includes a shaft 20, a compression unit 30, and a motor unit 50. The compression unit 30 includes a first impeller 31, a second impeller 32, and an impeller housing 33. The first impeller 31 and the second impeller 32 are attached to one end portion of the shaft 20. For example, the first impeller 31 and the second impeller 32 are disposed such that back surfaces of the first impeller 31 and the second impeller 32 face each other with a spacing therebetween. The first impeller 31 is disposed coaxially with the second impeller 32. The first impeller 31 is located between the second impeller 32 and the motor unit 50.

The impeller housing 33 includes a first housing 41 that accommodates the first impeller 31, and a second housing 42 that accommodates the second impeller 32. The second housing 42 is coupled in series to the first housing 41 in an axial direction D1 in which the shaft 20 extends. The first impeller 31 and the first housing 41 constitute a low-pressure compression stage that suctions and compresses a gas R1. The second impeller 32 and the second housing 42 constitute a high-pressure compression stage that further compresses the gas R1 compressed by the low-pressure compression stage. That is, the compressor 1 is a compressor in which the gas R1 compressed by the first impeller 31 is further compressed by the second impeller. Namely, the first impeller 31 is an impeller corresponding to the first-stage compressor. The second impeller 32 is an impeller corresponding to the second-stage compressor.

The compression unit 30 further includes an interstage plate 43 and an interstage housing 44. Each of the interstage plate 43 and the interstage housing 44 is an interstage component coupled to the impeller housing 33. The interstage plate 43 and the interstage housing 44 form, together with the impeller housing 33, an interstage passage 60 that introduces the gas R1 from the first impeller 31 of the low-pressure compression stage into the second impeller 32 of the high-pressure compression stage. Namely, the interstage passage 60 is a passage connecting the first-stage compressor and the second-stage compressor. The interstage plate 43 is a plate-shaped component sandwiched between the first housing 41 and the second housing 42. The interstage housing 44 is a housing component that is coupled to the second housing 42 from a side opposite the first housing 41 in the axial direction D1. The interstage housing 44 is coupled in series to the first housing 41 via the second housing 42 and the interstage plate 43 in the axial direction D1. The interstage plate 43, the first housing 41, and the second housing 42 may be members that are separately provided. These members are integrated (or connected together) to constitute the compression unit 30. Fastening means such as screws or bolts and nuts, or joining means such as welding or fusion joining can be used as means for integrating (or connecting together) the interstage plate 43, the first housing 41, and the second housing 42.

The motor unit 50 includes an electric motor 51 and a motor housing 52. The electric motor 51 is a drive source for driving the compression unit 30. The electric motor 51 is attached to the other end portion of the shaft 20. The shaft 20 is rotatably supported by a bearing inside the motor housing 52. The motor housing 52 accommodates the electric motor 51. The motor housing 52 is coupled in series to the first housing 41 in the axial direction D1. The motor housing 52, the first housing 41, the interstage plate 43, the second housing 42, and the interstage housing 44 are separate and independent components. The housing of the compressor 1 is formed by combining these components.

Figure 2:
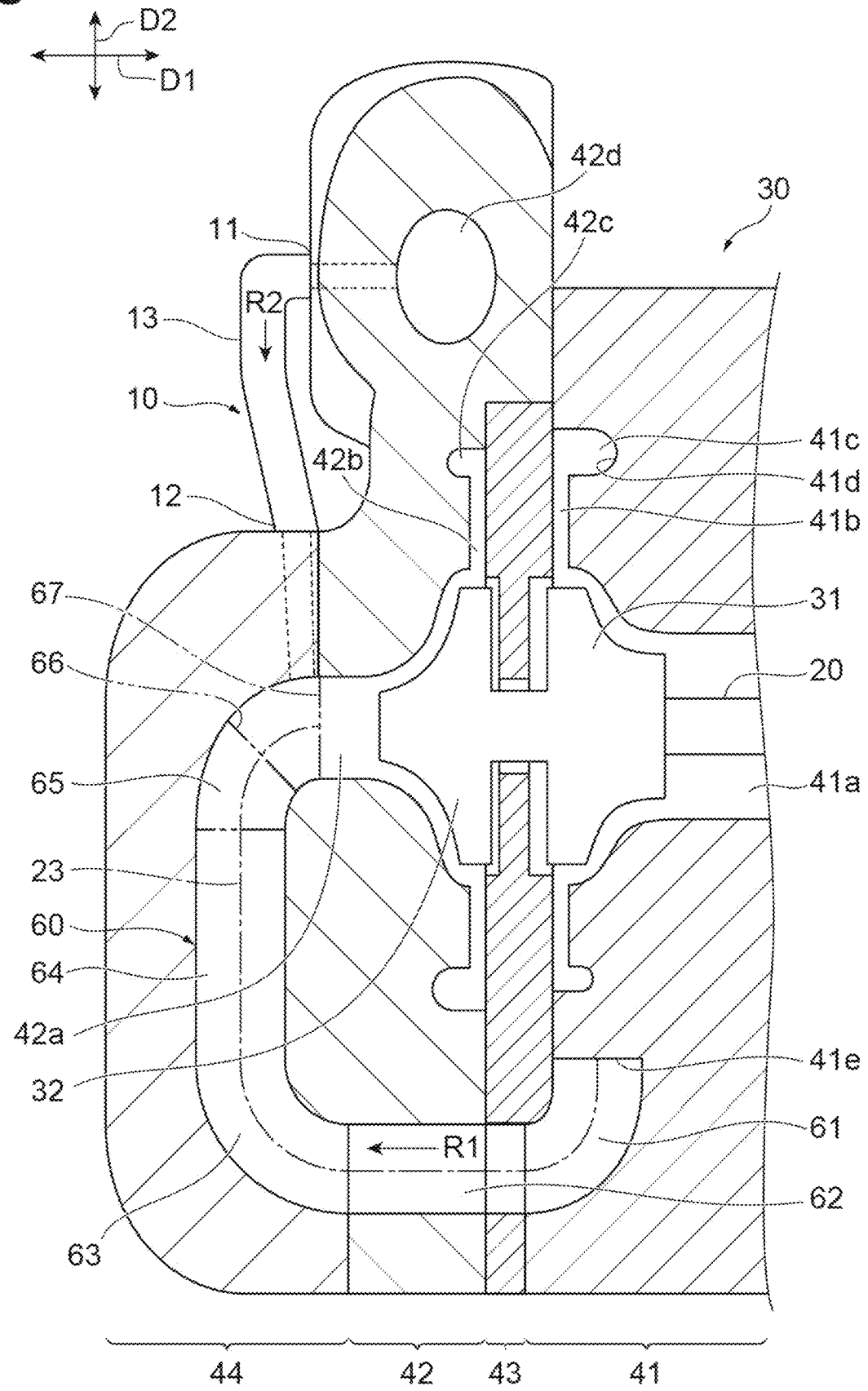
FIG. 2 is an enlarged cross-sectional view schematically illustrating a compression unit of the compressor of FIG. 1.

FIG. 2 is an enlarged cross-sectional view of the compression unit of the compressor of FIG. 1. As illustrated in FIG. 2, the first housing 41 includes an inlet 41*a*, a diffuser passage 41*b*, and a scroll passage 41*c*. The inlet 41*a* is an opening coaxial with the shaft 20, and communicates with the inside of the motor housing 52 (refer to FIG. 1). The gas R1 suctioned in from an inlet of the motor housing 52 flows into the inlet 41*a*. The first impeller 31 is disposed inward of the inlet 41*a*. Speed energy is applied to the gas R1 by rotation of the first impeller 31. The scroll passage 41*c* is formed to surround the first impeller 31. The diffuser passage 41*b* is formed between the first impeller 31 and the scroll passage 41*c*. The diffuser passage 41*b* compresses the gas R1 by converting the speed energy applied to the gas R1 into compression energy. The scroll passage 41*c* discharges the gas R1 compressed by the diffuser passage 41*b*.

The second housing 42 includes an inlet 42*a*, a diffuser passage 42*b*, a scroll passage 42*c*, and a scroll passage exit 42*d*. The inlet 42*a* is an opening coaxial with the inlet 41*a* of the first housing 41. The inlet 42*a* faces away from the inlet 41*a*. Namely, the inlet portion of the second impeller 32 faces away from an inlet portion of the first impeller 31, and a circumferential wall of the second housing 42 extends away from the impeller 31 to form the inlet 42*a*. The inlet 42*a* is connected to the scroll passage 41*c* of the first housing 41 via the interstage passage 60. Therefore, the gas R1 from the scroll passage 41*c* flows into the inlet 42*a* via the interstage passage 60. The second impeller 32 is disposed inward of the inlet 42*a*. Speed energy is applied to the gas R1 by rotation of the second impeller 32. The scroll passage 42*c* is formed to surround the second impeller 32. The diffuser passage 42*b* is formed between the second impeller 32 and the scroll passage 42*c*. The diffuser passage 42*b* further compresses the gas R1 by converting the speed energy applied to the gas R1 into compression energy. The scroll passage 42*c* discharges the compressed gas R1 from the scroll passage exit 42*d* to the outside.

A configuration of the interstage passage 60 will be described. In the following description, "above" and "upward" refer to, for example, an upper side in a vertical direction D2 when the compressor 1 is installed at the location of use. "Below" and "downward" refer to, for example, a lower side in the vertical direction D2 when the compressor 1 is installed at the location of use. In the example, the description will be given on the assumption that, in a state where the compressor 1 is installed at the location of use, the shaft 20 is disposed to extend in a horizontal direction. The axial direction D1 is perpendicular to the vertical direction D2.

The interstage passage 60 includes, for example, a curved passage 61, a linear passage 62, a curved passage 63, a linear passage 64, and a curved passage 65. These passages are formed along the same plane. The same plane may be, for example, a plane along the axial direction D1 and the vertical direction D2. FIG. 2 illustrates, for example, a longitudinal cross-section of the compression unit 30 including the curved passage 61, the linear passage 62, the curved passage 63, the linear passage 64, and the curved passage 65, that is taken along a plane extending in the axial direction D1 and the vertical direction D2 so as to pass through a center line 23 of the interstage passage 60. The curved passage 61, the linear passage 62, the curved passage 63, the linear passage 64, and the curved passage 65 are disposed in order from upstream to downstream in the flow direction of the gas R1 traveling from the first impeller 31 toward the second impeller 32. The center line 23 is curved along the curved passages 61, 63 and 65 in the longitudinal cross-section illustrated at FIG. 2.

The linear passage 62 extends in the axial direction D1 below the second impeller 32. For example, the linear passage 62 extends parallel to the shaft 20. The curved passage 61 is located below the first impeller 31. The curved passage 61 extends between an exit 41*e* of the scroll passage 41*c* and the linear passage 62 so as to curve in an arc shape. The curved passage 63, the linear passage 64, and the curved passage 65 are located on a side opposite the first impeller 31 with respect to the second impeller 32 in the axial direction D1.

The linear passage 64 extends linearly along the vertical direction D2 at a position above the linear passage 62 and below the shaft 20. The curved passage 63 is disposed opposite the curved passage 61 with the linear passage 62 sandwiched therebetween in the axial direction D1. The curved passage 63 extends to curve in an arc shape between the linear passage 62 and the linear passage 64. The curved passage 65 is disposed opposite the curved passage 63 with the linear passage 64 sandwiched therebetween in the vertical direction D2. The curved passage 65 extends to curve in an arc shape between the linear passage 64 and the inlet 42*a*. That is, the interstage passage 60 includes the curved passage (bent portion) 65 at the inlet 42*a* which is the inlet portion of the second impeller 32. Namely, the curved passage 65 extends from the linear passage 64 to the inlet 42*a* of the second housing 42. Accordingly, the curved passage 65 forms the outlet end of the interstage passage 60.

Each passage cross-sectional area of the interstage passage 60 is, for example, constant. An annular seal member such as an O-ring that suppresses the occurrence of leakage of the gas R1 may be installed at connecting portions between the components of the interstage passage 60.

The compressor 1 includes a bypass passage 10 that recirculates a gas R2 from downstream of the second impeller 32 to the interstage passage 60. The bypass passage 10 suppresses surging at the second impeller 32 of the compressor 1.

The bypass passage 10 includes an upstream end 11, a downstream end 12, and a connecting portion 13. The upstream end 11 communicates with a passage downstream of the second impeller 32. The downstream end 12 communicates with a passage upstream of the second impeller 32. The connecting portion 13 connects the upstream end 11 and the downstream end 12. In the bypass passage 10, the gas R2 is allowed to flow from the upstream end 11 to the downstream end 12 via the connecting portion 13 due to a pressure difference of the gas R1 between the upstream end 11 and the downstream end 12.

The upstream end 11 introduces the gas R1, which is compressed by the second impeller 32, as the gas R2 to be recirculated. The gas R2 is a high-pressure gas that has a higher pressure than that upstream of the second impeller 32 due to being compressed by the second impeller 32. For example, the upstream end 11 is connected to a portion of the second housing 42, which constitutes the scroll passage exit 42*d*, so as to communicate (to be fluidly coupled) with the scroll passage exit 42*d*, to receive the compressed gas R1 discharged from the scroll passage 42*c*. Namely, the scroll passage exit 42*d* is located in a downstream region relative to the second impeller 32, in the general flow direction of the gas R1, and the bypass passage 10 recirculates the compressed gas R2 from the downstream region of the second impeller 32 to the interstage passage 60.

The downstream end 12 causes the gas R2 introduced from the upstream end 11 to flow out upstream of the second impeller 32. The downstream end 12 referred to here is connected to the interstage housing 44 so as to communicate (to be fluidly coupled) with the inside of the interstage passage 60. Namely, the downstream end 12 extends into the interstage housing 44, and further protrudes from an inner circumferential wall 68 of the interstage passage 60, to further extend into the interstage passage 60 (cf. FIG. 3). In the bypass passage 10, the gas R2 flows from the scroll passage exit 42*d* to the interstage passage 60 due to a pressure difference of the gas R1 between the scroll passage exit 42*d* and the interstage passage 60.

The bypass passage 10 is formed from, for example, a pipe member made of stainless steel, etc. A part of the bypass passage 10 may be formed as a part of the second housing 42 by casting. A part of the bypass passage 10 may be formed as a part of the interstage housing 44 by casting.

In addition to suppressing surging at the second impeller 32, the bypass passage 10 mitigates the swirling flow of the gas R1 flowing into the second impeller 32. The swirling flow of the gas R1 refers to the flow of the gas R1 flowing into the second impeller 32 while swirling. When the gas R1 is compressed by the first impeller 31, the swirling flow of the gas R1 is generated, for example, in the scroll passage 41*c*. The scroll passage 41*c* has an inner wall surface 41*d*, a part of which forms an arc cross-sectional shape of the passage. In the scroll passage 41*c*, the gas R1 flows along the diffuser passage 41*b*. In the scroll passage 41*c*, the gas R1 flows in a swirling manner along the inner wall surface 41*d*. In this state, the gas R1 advances through the scroll passage 41*c* along a circumferential direction of the first impeller 31. Accordingly, a flow of the gas R1 accompanied by a swirling flow is formed. In some examples, the first impeller 31 may rotate in a direction that causes the gas R1 that flows in the interstage passage 60, to swirl in a swirling direction that spirals around the center line 23 along the interstage passage 60. The swirling direction follows substantially a circumferential direction of the interstage passage 60, when viewed from a transverse cross-section of the interstage passage 60, that is taken substantially orthogonally to the center line 23 of the interstage passage 60 (cf. FIG. 3). The center line 23 extends longitudinally at a cross-sectional center of the interstage passage 60 along the general flow direction of the gas R1, from an inlet (cf. first end at 41*e*) of the interstage passage 60, located adjacent to the first impeller 31, to an outlet (cf. second end at 67) of the interstage passage 60, located adjacent to the second impeller 32. The swirling flow of the gas R1 reaches the inlet 42*a* and the second impeller 32 via the interstage passage 60. At the inlet 42*a*, the swirling flow of the gas R1 can swirl around the axial direction D1 in the same direction as a rotation direction of the second impeller 32 or in the opposite direction, for example, depending on a rotation direction of the first impeller 31, a winding direction of the scroll passage 41*c*, etc.

Figure 3:
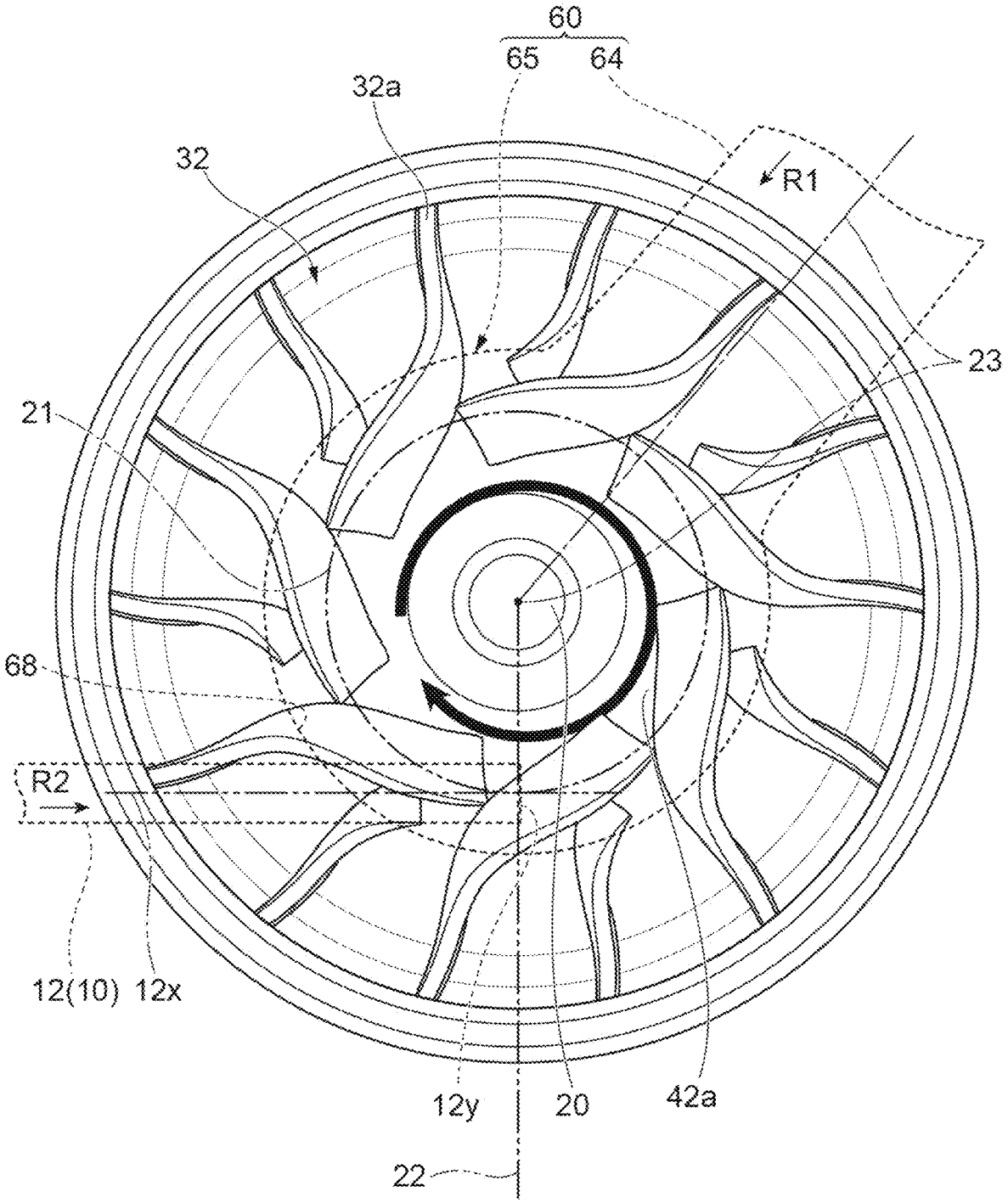
FIG. 3 is a schematic cross-sectional view illustrating a swirling flow of gas, at an inlet of an impeller of the compressor of FIG. 1.

FIG. 3 is a view illustrating a swirling flow at the inlet before the second impeller. In FIG. 3, the second impeller 32 is depicted by solid lines in a plan view as viewed from an interstage passage 60 side in the axial direction D1 in FIG. 2. In FIG. 3, the linear passage 64 and the curved passage 65 are depicted by dashed lines in a plan view as viewed from the interstage passage 60 side in the axial direction D1 in FIG. 2. In the example of FIG. 3, the gas R1 flows through the linear passage 64, which is located at the upper right of the drawing sheet, toward the center of the drawing sheet. The gas R1 flows through the curved passage 65, which is located at the center of the drawing sheet, while bending toward the back side of the drawing sheet, and heads toward the inlet 42*a* on the back side of the drawing sheet. As an example, the swirling direction of the swirling flow of gas R1 at the portion of the inlet 42*a* is clockwise as indicated by a thick solid arc-shaped arrow. The portion of the inlet 42*a* is located downstream of the curved passage 65. The swirling direction of the swirling flow of the gas R1 can be identified, for example, based on streamline vectors obtained by simulating the flow of the gas R1 in the compressor 1. The swirling flow of the gas R1 at the portion of the inlet 42*a* swirls in accordance with a direction in which the gas R1 in the interstage passage 60 swirls in the passage cross-section of the interstage passage 60.

In the example of FIG. 3, when the second impeller 32 rotates, the gas R1 is centrifugally compressed by a plurality of large and small blades 32*a*. In the example of FIG. 3, the rotation direction of the second impeller 32 is counterclockwise. For that reason, the swirling flow of the gas R1, the swirling direction of which is clockwise, swirls (counter-swirls) in the direction opposite the rotation direction of the second impeller 32. When such a swirling flow of the gas R1 enters the second impeller 32, a surge tends to occur easily. It should be noted that, unlike the example of FIG. 3, when a counterclockwise swirling flow (pre-swirl) that swirls in the same direction as the second impeller 32 enters the second impeller 32, the rotation direction of which is counterclockwise, a decrease in the pressure ratio before and after the second impeller 32 tends to occur easily.

In order to mitigate the swirling flow of the gas R1, the swirling direction of which is clockwise, the downstream end 12 opens to the interstage passage 60 so as to face the direction of the swirling flow of the gas R1, as partially indicated by a rectangular dashed line in FIG. 3. Namely, the downstream end 12 is oriented to direct the recirculated gas R2 against the swirling direction of the gas R1 in the transverse cross-section of the interstage passage 60 illustrated in FIG. 3.

With reference to FIG. 2, the downstream end 12 opens at a downstream side (or downstream portion) of the curved passage 65, and the downstream side (or downstream portion) of the curved passage 65 is located downstream of a midpoint 66 of a bent section of the curved passage 65 in the flow direction of the gas R1. The downstream side of the curved passage 65 may be downstream of an end point 67 of the bent section of the curved passage 65 in the flow direction of the gas R1. The downstream end 12 referred to here is connected to the interstage housing 44 so as to open between the end point 67 of the bent section of the curved passage 65 and the inlet 42*a* of the second housing 42. It should be noted that the downstream end 12 may be connected to the second housing 42 so as to open downstream of the curved passage 65. For example, the downstream end 12 of the bypass passage 10 may be open to the interstage passage 60, at a location between the midpoint 66 of the curved passage 65 and the second impeller 32.

As illustrated in FIG. 3, as an example, an opening direction (or extending direction) 12*x* of the downstream end 12 is along a tangent direction of an imaginary concentric circle 21, which is concentric with the shaft 20 or with the center line 23, at the portion of the inlet 42*a* in the cross-sectional view of FIG. 3. A position of an opening 12*y* of the downstream end 12 may be on an imaginary line (or radial axis) 22 extending in a radial direction of the imaginary concentric circle 21 concentric with the shaft 20, or in a radial direction from the center line 23 of the interstage passage 60, in the transverse cross-section. Namely, the downstream end 12 of the bypass passage 10 extends into the interstage passage 60 in the extending direction 12*x*, to the opening 12*y* which is formed along the radial axis 22. For example, the downstream end 12 has an end surface forming the opening 12*y*, that extends along the radial axis 22. The imaginary line (radial axis) 22 and the opening direction (extending direction) 12*x* of the downstream end 12 are perpendicular to each other. Since the gas R2 to be recirculated flows out along the opening direction 12*x*, the gas R2 to be recirculated flows out along a tangent to the concentric circle 21 of the shaft 20 of the second impeller 32. The swirling flow of the gas R1 has a clockwise flow speed component along a circumferential direction of the concentric circle 21. Therefore, the gas R2 flows out with a flow speed component in the direction opposite the swirling flow of the gas R1. The gas R2 flows out to face the swirling flow of the gas R1 on the tangent to the concentric circle 21. The opening direction 12*x* and the position of the opening 12*y* of the downstream end 12 are not limited to this example, and for example, may be adjusted according to the strength (swirling speed in the cross-section), direction, distribution, etc. of the swirling flow of the gas R1 with reference to the streamline vectors obtained by simulation. It should be noted that the bypass passage 10 may have a constant inner diameter or may taper toward the downstream end 12.

The direction and strength of the swirling flow of the gas R1 in the passage cross-section from the first impeller 31 to the second impeller 32 is determined before passing through the curved passage 65, and do not increase any more downstream of the curved passage 65. In this way, by opening the downstream end 12 so as to face the direction of the swirling flow of the gas R1 downstream of the curved passage 65, swirling is less likely to be generated again in the flow of the gas R1 after the swirling flow of the gas R1 is mitigated.

The bypass passage 10 may be provided with an adjustment valve that adjusts the flow rate of the gas R2. The adjustment valve is adjusted to mitigate the swirling flow of the gas R1 flowing into the second impeller 32, while suppressing surge at the second impeller 32 of the compressor 1. The adjustment valve may be adjusted, for example, based on the rotation speed of the shaft 20, the flow rate and pressure of the gas R1, etc. The drive rotation speed of the electric motor, the measured rotation speed of a turbine, etc. can be used as the rotation speed of the shaft 20. The flow rate and pressure of the gas R1 may be measured values (for example, the downstream pressure of the second impeller 32 or the interstage pressure). The flow rate and pressure of the gas R1 may be substituted by the output of the motor unit 50.

In the compressor 1 as described above, the gas R1 compressed by the second impeller 32 is recirculated as the gas R2 to the interstage passage 60 from downstream of the second impeller 32 via the bypass passage 10, and flows out from the downstream end 12 of the bypass passage 10 into the interstage passage 60. The downstream end 12 of the bypass passage 10 faces the direction in which the gas R1 in the interstage passage 60 swirls in the passage cross-section of the interstage passage 60. The gas R2 flows out from the downstream end 12 of the bypass passage 10 into the interstage passage 60. Accordingly, the swirling flow generated in the gas R1 when the gas R1 is compressed by the first impeller 31 is weakened by the gas R2. Therefore, according to the compressor 1, the influence of the swirling flow, which is generated in the gas R1 when the gas R1 is compressed by the first impeller 31, on the second impeller 32 can be suppressed.

Surge is suppressed by the circulation flow bypassing from the scroll passage exit 42*d* of the high-pressure stage to the inlet 42*a* of the high-pressure stage. By returning the circulation flow in a direction in which the swirling of the gas R1 is cancelled out upstream of the second impeller 32 of the high-pressure stage, a decrease in the performance of the compressor 1 can be suppressed.

In the compressor 1, the interstage passage 60 includes the curved passage (bent portion) 65 at the inlet 42*a* which is the inlet portion of the second impeller 32. The downstream end 12 of the bypass passage 10 opens downstream of the curved passage 65. According to this configuration, since the swirling flow is weakened at the inlet portion of the second impeller 32, the influence of the swirling flow on the second impeller 32 can be effectively suppressed.

In the compressor 1, the opening direction 12*x* of the downstream end 12 is along the tangential direction of the imaginary concentric circle 21 concentric with the shaft 20 of the second impeller 32. According to this configuration, the gas R2 to be recirculated flows out along the tangent to the concentric circle 21 of the shaft 20 of the second impeller 32. For that reason, the influence of the swirling flow having a flow speed component along the circumferential direction of the concentric circle 21 can be suppressed more effectively.

In the compressor 1, the position of the opening 12*y* of the downstream end 12 is on the imaginary line 22 that extends in the radial direction of the imaginary concentric circle 21 concentric with the shaft 20 of the second impeller 32, and that is perpendicular to the opening direction 12*x* of the downstream end 12. According to this configuration, the gas to be recirculated flows out to face the swirling flow on the tangent to the concentric circle 21 of the shaft 20 of the second impeller 32. For that reason, the influence of the swirling flow having a flow speed component of the concentric circle 21 can be suppressed more effectively.

It is to be understood that not all aspects, advantages and features described herein may necessarily be achieved by, or included in, any one particular example. Indeed, having described and illustrated various examples herein, it should be apparent that other examples may be modified in arrangement and detail.

Figure 4:
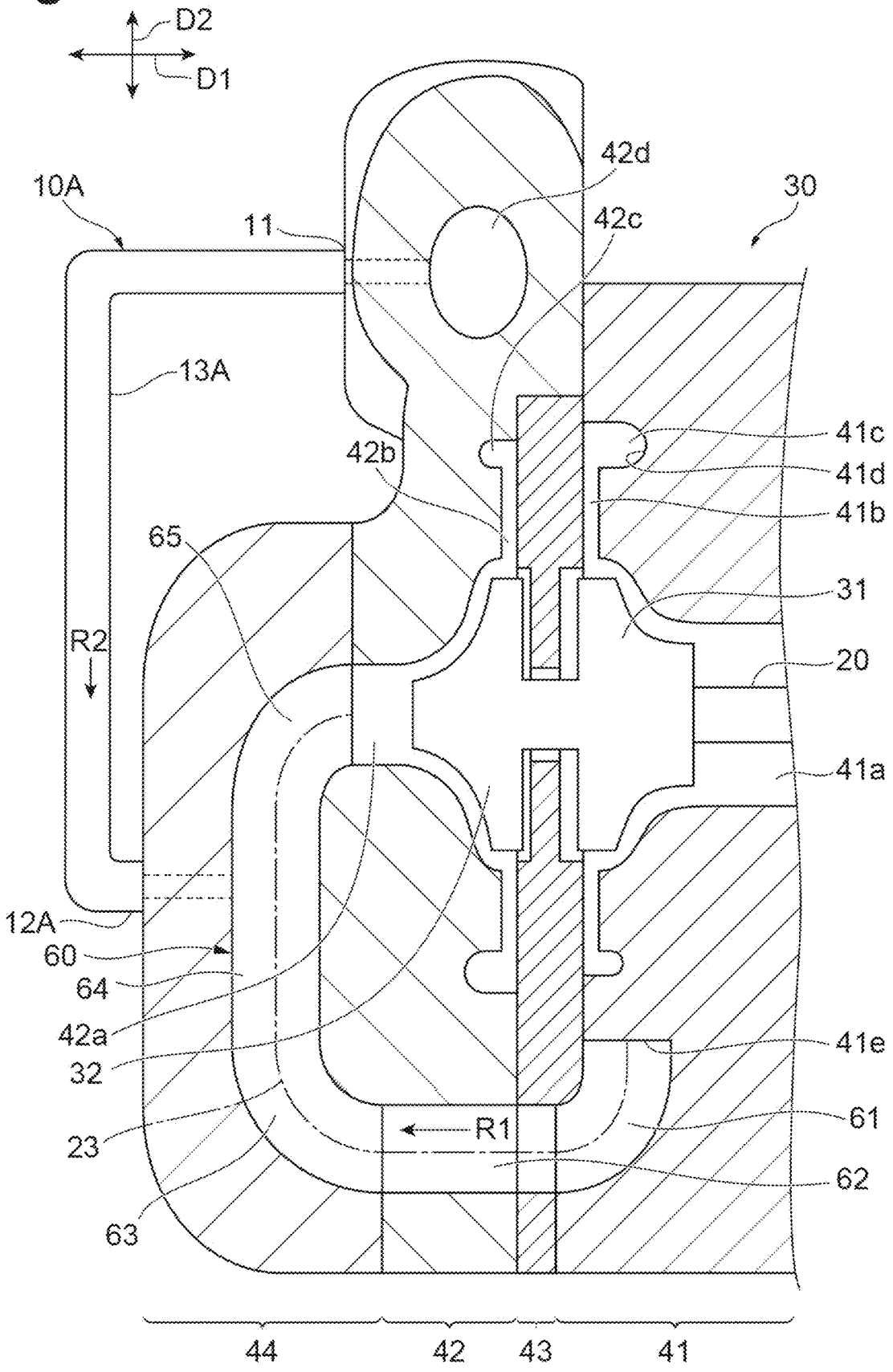
FIG. 4 is an enlarged cross-sectional view schematically illustrating a compression unit in another example compressor.

For example, in the above-described example, the downstream end 12 of the bypass passage 10 opens downstream of the curved passage 65; however, one of other downstream ends of the bypass passage may be, for example, as illustrated in FIG. 4, a downstream end 12A of a bypass passage 10A that opens upstream of the curved passage 65, at a location that is along the linear passage 64. The bypass passage 10A includes the upstream end 11, the downstream end 12A, and a connecting portion 13A. The upstream end 11 communicates with a passage downstream of the second impeller 32. The downstream end 12A communicates with a passage upstream of the curved passage 65. The connecting portion 13A connects the upstream end 11 and the downstream end 12A. The downstream end 12A causes the gas R2 introduced from the upstream end 11 to flow upstream of the curved passage 65. The downstream end 12A referred to here is connected to the interstage housing 44 so as to communicate (to be fluidly coupled) with the inside of the linear passage 64. In the bypass passage 10A, the gas R2 flows from the scroll passage exit 42*d* to the linear passage 64 due to a pressure difference of the gas R1 between the scroll passage exit 42*d* and the linear passage 64. The bypass passage 10 described above is open downstream of the curved passage 65 in order to direct the flow of the gas R2 to the swirling flow of the gas R2 in a state where the direction and strength of the swirling flow of the gas R1 in the passage cross-section from the first impeller 31 to the second impeller 32. In contrast, in the bypass passage 10A according to a modification example, the downstream end 12A is made open such that the swirling flow of the gas R1 is contained downstream of the curved passage 65, while taking into consideration a change in the swirling flow applied to the gas R1 before and after the curved passage 65. The downstream end 12A is made open in a direction in which the swirling of the gas R1 from the first impeller 31 inside the linear passage 64 is canceled out in advance by the recirculated gas R2. The streamline vectors obtained by simulation can be referenced for a change in the swirling flow applied to the gas R1 before and after the curved passage 65.

In the above-described example, each passage cross-sectional area of the interstage passage 60 is constant; however, one of other interstage passages may include a part of the interstage passage that has an area different from that of the other portions. For example, by utilizing the fact that when the cross-sectional area of the interstage passage 60 is large, the swirling flow of the gas R1 becomes slower, and when the cross-sectional area of the interstage passage 60 is small, the swirling flow of the gas R1 becomes faster, and providing the downstream end of the bypass passage at a portion of the interstage passage 60, which has a larger cross-sectional area than other portions, the recirculated gas R2 may be directed to a region where the flow speed of the swirling flow of the gas R1 has decreased. In this case, the swirling flow of the gas R1 is easily mitigated.

In the above-described example, the interstage passage 60 includes the curved passage (bent portion) 65 at the inlet 42*a* which is the inlet portion of the second impeller 32; however, one of other interstage passages may include, for example, a straight pipe passage that is connected to the inlet 42*a* which is the inlet portion of the second impeller 32. The curved passage 65 and the inlet 42*a* of the second impeller 32 may be connected to each other via a straight pipe passage. The inlet 42*a* of the second impeller 32 and the inlet 41*a* of the first impeller 31 may be connected to each other via a straight pipe passage. It should be noted that even when there is no bent portion such as the interstage passage 60 from the first impeller 31 of the low-pressure stage to the second impeller 32 of the high-pressure stage, the swirling flow of the gas R1 is generated in the scroll passage 41*c* of the first impeller 31, etc.

In the above-described example, the upstream end 11 of the bypass passage 10 communicates with the scroll passage exit 42*d*; however, one of other upstream ends of the bypass passage may include, for example, the upstream end of the bypass passage that communicates with the scroll passage 42*c*. The upstream end of the bypass passage may communicate with the diffuser passage 42*b*. In short, the upstream end of the bypass passage may be provided to communicate with the flow passage downstream of the second impeller and to introduce the gas compressed by the second impeller as the gas to be recirculated.

In the above-described example, the first impeller 31 and the second impeller 32 are disposed such that the back surfaces thereof face each other with a spacing therebetween; however, one of other first impellers and second impellers may be disposed (disposed in series) such that the back surface of one faces the front surface of the other.

In the above-described example, the interstage passage 60 is composed of four components, namely, the first housing 41, the second housing 42, the interstage plate 43, and the interstage housing 44, however, one of other interstage passage may be formed by components of the number other than four. For example, the interstage plate may not extend downward until reaching the interstage passage, and the second housing may be directly connected to the first housing. A pipe for connecting the first housing and the second housing may be provided separately.

In the above-described example, a two-stage compressor has been described as an example; however, one of other numbers of stages of the compressor may be three or more. For example, when the compressor is a serial three-stage compressor, the interstage passage through which the gas is recirculated may be a passage connecting a second-stage compressor and a third-stage compressor. In this case, the first impeller may be an impeller corresponding to the second-stage compressor, the second impeller is an impeller corresponding to the third-stage compressor, and the bypass passage may recirculate the gas from downstream of the second impeller corresponding to the third-stage compressor to the interstage passage connecting the second-stage compressor and the third-stage compressor. The same applies even when the number of stages of the compressor is four or more. In short, the bypass passage may recirculate the gas from downstream of the second impeller to the interstage passage.

In the above-described example, an electric centrifugal compressor has been provided as an example of the compressor 1; however, one of other compressors may be, for example, configured as a turbocharger that operates on exhaust gas in a vehicle, etc., or a mixed-flow turbo compressor. In short, the present disclosure can be widely applied to, for example, compressors in which the gas R1 compressed by the first impeller 31 is further compressed by the second impeller and in which a swirling flow is generated due to the rotation component of centrifugal compression, except for jet engines in which fixed blades that return a swirling flow to an axial flow are provided on a housing.

The invention claimed is:

1. A compressor comprising:

a first impeller configured to compress a gas;

a second impeller configured to further compress the gas compressed by the first impeller and to direct the gas to a downstream region that is located downstream of the second impeller in a flow direction of the gas;

an interstage passage configured to direct the gas from the first impeller to the second impeller, wherein the gas is caused to swirl in a swirling direction that substantially corresponds to a circumferential direction of the interstage passage, when viewed from a transverse cross-section of the interstage passage; and a bypass passage configured to recirculate the gas from the downstream region of the second impeller to the interstage passage, wherein the bypass passage has a downstream end that opens to the interstage passage, and wherein the downstream end is oriented to direct the recirculated gas against the swirling direction of the gas in the transverse cross-section of the interstage passage.

2. The compressor according to claim 1, wherein the interstage passage includes a curved passage located adjacent to an inlet portion of the second impeller, and wherein the downstream end of the bypass passage forms an opening in the interstage passage that is located at a downstream portion of the curved passage, in a flow direction of the gas supplied from the first impeller toward the second impeller.

3. The compressor according to claim 2, wherein the second impeller is configured to rotate about a shaft, and wherein the downstream end of the bypass passage extends to the opening along a tangent of a concentric circle that is concentric with the shaft of the second impeller, in the transverse cross-section of the interstage passage.

4. The compressor according to claim 2, wherein the downstream end of the bypass passage extends into the interstage passage in an extending direction, and wherein the opening of the downstream end of the bypass passage is formed along a radial direction of a shaft, that is perpendicular to the extending direction of the downstream end.

5. The compressor according to claim 1, further comprising:

a first housing that accommodates the first impeller, wherein the first housing includes a first inlet configured to direct the gas to the first impeller, a first scroll passage that surrounds the first impeller and that is configured to supply the gas to the interstage passage, and a first diffuser passage configured to direct the gas from the first impeller to the first scroll passage; and a second housing that accommodates the second impeller, wherein the second housing includes a second inlet configured to direct the gas from the interstage passage to the second impeller, a second scroll passage that surrounds the second impeller, a second diffuser passage configured to direct the gas from the second impeller to the second scroll passage, and a scroll passage exit configured to discharge the gas from the second scroll passage, and wherein the bypass passage has an upstream end located opposite to the downstream end, that is connected to the scroll passage exit of the second housing.

6. The compressor according to claim 5, further comprising an interstage housing that accommodates the interstage passage, wherein the second housing is interposed between the interstage housing and the first housing in an axial direction in which a shaft extends, and wherein the downstream end of the bypass passage is connected to the interstage housing so as to be fluidly coupled with the interstage passage.

7. The compressor according to claim 6, wherein the interstage passage includes a linear passage, and a curved passage extending from the linear passage to an inlet of the second housing, that forms an inlet portion of the second impeller, and wherein the downstream end of the bypass passage is open to the interstage passage, at a location between a midpoint of the curved passage and the second impeller.

8. The compressor according to claim 6, wherein the interstage passage includes a linear passage, and a curved passage extending from the linear passage to an inlet of the second housing, that forms an inlet portion of the second impeller, and wherein the downstream end of the bypass passage is open to the interstage passage at a location that is along the linear passage.

9. The compressor according to claim 1, wherein the interstage passage has an inlet end located adjacent to the first impeller, an outlet end located adjacent to the second impeller, and a center line extending from the inlet end to the outlet end, and wherein the gas spirals around the center line in the swirling direction, along the interstage passage.

10. The compressor according to claim 1, wherein the bypass passage tapers toward the downstream end.

11. The compressor according to claim 1, further comprising a housing having an inner wall that forms the interstage passage, wherein the downstream end of the bypass passage protrudes from the inner wall of the housing into the interstage passage.

12. A compressor comprising:

a first impeller configured to compress a gas;

a second impeller configured to further compress the gas compressed by the first impeller and to direct the gas to a downstream region that is located downstream of the second impeller in a flow direction of the gas;

an interstage passage configured to direct the gas from the first impeller to the second impeller; and a bypass passage configured to recirculate the gas from the downstream region of the second impeller, to the interstage passage, wherein the bypass passage has a downstream end that protrudes into the interstage passage, to fluidly couple the bypass passage with the interstage passage.

13. The compressor according to claim 12, wherein the interstage passage has a first end located adjacent to the first impeller and a second end located adjacent to the second impeller, and a center line extending from the first end to the second end, wherein the first impeller is configured to rotate in a direction that causes the gas flowing in the interstage passage, to swirl in a swirling direction that spirals around the center line along the interstage passage, wherein the swirling direction corresponds substantially to a circumferential direction of the interstage passage, when viewed from a transverse cross-section of the interstage passage, taken substantially orthogonally to the center line, and wherein the downstream end is configured to direct the recirculated gas against the swirling direction of the gas, in the transverse cross-section of the interstage passage.

14. The compressor according to claim 13, wherein the transverse cross-section of the interstage passage is taken adjacent to an inlet of the second impeller, and wherein the second impeller is configured to rotate in a direction that is opposite to the swirling direction of the gas, when viewed from the transverse cross-section.

15. The compressor according to claim 13, wherein the downstream end of the bypass passage extends along a tangent of a concentric circle that is concentric with the center line of the interstage passage, in the transverse cross-section.

16. The compressor according to claim 13, wherein the downstream end has an end surface forming an opening to fluidly couple the bypass passage with the interstage passage, and wherein the end surface extends along a radial axis of the center line, in the transverse cross-section.

17. The compressor according to claim 12, wherein the interstage passage has an inlet end located adjacent to the first impeller, an outlet end located adjacent to the second impeller, and a center line extending from the inlet end to the outlet end, wherein a longitudinal cross-section of the compressor, is taken along the center line of the interstage passage, wherein the interstage passage includes a curved passage located adjacent to the outlet end, along which the center line is curved in the longitudinal cross-section, and wherein the downstream end of the bypass passage forms an opening that is located between a midpoint of the curved passage and the second impeller, in the longitudinal cross-section.

18. The compressor according to claim 17, wherein the curved passage forms the outlet end of the interstage passage, wherein an inlet portion of the second impeller extends linearly from the outlet end formed by the curved passage, and wherein the opening of the downstream end of the bypass passage is located adjacent to the outlet end of the curved passage.

19. The compressor according to claim 12, wherein the interstage passage includes a linear passage, and a curved passage extending from the linear passage toward an inlet portion of the second impeller, and wherein the downstream end of the bypass passage is open to the interstage passage at a location that is along the linear passage.

20. The compressor according to claim 12, further comprising:

a housing that accommodates the second impeller, wherein the housing forms a scroll passage in the downstream region of the second impeller, wherein the scroll passage surrounds the second impeller and is configured to discharge compressed gas from the second impeller, wherein the bypass passage has an upstream end located opposite the downstream end, to direct a recirculated gas from the upstream end to the downstream end, and wherein the upstream end of the bypass passage is fluidly coupled with the scroll passage, to receive the compressed gas discharged from the scroll passage.

* * * * *